US010543527B2

(12) United States Patent
Toishi et al.

(10) Patent No.: US 10,543,527 B2
(45) Date of Patent: Jan. 28, 2020

(54) CONTINUOUS STEEL CASTING METHOD

(71) Applicant: JFE Steel Corporation, Tokyo (JP)

(72) Inventors: Keigo Toishi, Chiba (JP); Hiroyuki Ono, Chiba (JP); Norichika Aramaki, Fukuyama (JP); Yuji Miki, Chiba (JP)

(73) Assignee: JFE Steel Corporation, Tokyo (JP)

( * ) Notice: Subject to any disclaimer, the term of this patent is extended or adjusted under 35 U.S.C. 154(b) by 158 days.

(21) Appl. No.: 15/532,531

(22) PCT Filed: Dec. 24, 2014

(86) PCT No.: PCT/JP2014/006415
§ 371 (c)(1),
(2) Date: Jun. 2, 2017

(87) PCT Pub. No.: WO2016/103293
PCT Pub. Date: Jun. 30, 2016

(65) Prior Publication Data
US 2017/0326627 A1 Nov. 16, 2017

(51) Int. Cl.
*B22D 11/20* (2006.01)
*B22D 11/128* (2006.01)

(52) U.S. Cl.
CPC ..... *B22D 11/207* (2013.01); *B22D 11/1282* (2013.01); *B22D 11/1287* (2013.01)

(58) Field of Classification Search
CPC . B22D 11/041; B22D 11/1206; B22D 11/128; B22D 11/1282; B22D 11/1287; B22D 11/20; B22D 11/207; B21B 1/463; B21B 2201/14
USPC ..... 164/484, 454, 476, 417
See application file for complete search history.

(56) References Cited

U.S. PATENT DOCUMENTS

| | | | |
|---|---|---|---|
| 4,687,047 | A | 8/1987 | Ogibayashi et al. |
| 2004/0129405 | A1 | 7/2004 | Streubel et al. |
| 2013/0186588 | A1 | 7/2013 | Eckerstorfer et al. |
| 2013/0192790 | A1 | 8/2013 | Eckerstorfer et al. |

FOREIGN PATENT DOCUMENTS

| | | | |
|---|---|---|---|
| CN | 1529643 | A | 9/2004 |
| CN | 102149492 | | 8/2011 |
| CN | 203470858 | | 3/2014 |
| EP | 0 211 422 | | 2/1987 |
| EP | 0663250 | A1 | 7/1995 |
| JP | 2016-019993 | | 2/1916 |
| JP | 62-33048 | A | 2/1987 |
| JP | 3-90259 | A | 4/1991 |
| JP | 3-90263 | A | 4/1991 |
| JP | H06262325 | A | 9/1994 |

(Continued)

OTHER PUBLICATIONS

Korean Office Action dated Apr. 3, 2018, of corresponding Korean Application No. 2017-7015965, along with a Concise Statement of Relevance of Office Action in English.

(Continued)

*Primary Examiner* — Kevin P Kern
(74) *Attorney, Agent, or Firm* — DLA Piper LLP (US)

(57) ABSTRACT

Conditions for soft reduction are determined in a method of continuous casting in accordance with a method utilizing the thickness of a slab strand to prevent center segregation from occurring in the strand due to an insufficient pressing rate or internal cracks from occurring in the strand due to an excessively high pressing rate.

2 Claims, 2 Drawing Sheets

(56) References Cited

FOREIGN PATENT DOCUMENTS

| | | | |
|---|---|---|---|
| JP | H078421 | B2 | 2/1995 |
| JP | 8-132203 | A | 5/1996 |
| JP | 2003-71552 | A | 3/2003 |
| JP | 3633573 | B2 | 3/2005 |
| JP | 4177541 | B2 | 11/2008 |
| JP | 2010-82638 | | 4/2010 |
| JP | 2012-218047 | | 11/2012 |
| JP | 5413289 | B2 | 2/2014 |
| JP | 5476959 | B2 | 4/2014 |
| JP | 2014-231086 | A | 12/2014 |
| JP | 2014-233726 | A | 12/2014 |
| JP | 2014231086 | A | 12/2014 |
| JP | 2014233726 | A | 12/2014 |
| JP | 2015-009264 | | 1/2015 |
| RU | 137488 | U1 | 2/2014 |
| TW | 365554 | | 8/1999 |
| TW | 434059 | | 5/2001 |
| WO | 2012049107 | A1 | 4/2012 |
| WO | 2012049135 | A1 | 4/2012 |

OTHER PUBLICATIONS

Taiwanese Office Action dated Jul. 13, 2016, of corresponding Taiwanese Application No. 103145474, along with a Search Report in English.

Supplementary European Search Report dated Sep. 1, 2017, of corresponding European Application No. 14908904.7.

Chinese Office Action dated Jun. 19, 2018, of counterpart Chinese Application No. 201480084080.1, along with a Concise Statement of Relevance of Office Action in English.

Russian Office Action dated Jun. 26, 2018, of counterpart Russian Application No. 2017122015, along with a Search Report in English.

Korean Grant of Patent dated Sep. 27, 2018, of counterpart Korean Application No. 10-2017-7015965, along with an English translation.

CONTINUOUS STEEL CASTING METHOD

TECHNICAL FIELD

This disclosure relates to a method of continuous steel casting that prevents component segregation occurring at a thickness-wise middle portion of a continuously cast strand, that is, center segregation.

BACKGROUND

During a final process of solidification in continuous casting of steel, the unsolidified part of molten steel (referred to as "unsolidified layer") is withdrawn in accordance with solidification shrinkage, whereby the unsolidified part of the molten steel flows in the direction of withdrawal of the strand. In the unsolidified layer, solute elements such as carbon (C), phosphorus (P), sulfur (S), and manganese (Mn) are concentrated. When the concentrated molten steel flows in the middle portion of the strand and is solidified in that portion, so-called center segregation occurs. Examples of the causes of the flow of the concentrated molten steel at the end of the solidification include, besides the above-described solidification shrinkage, bulging of the strand between rolls due to molten steel static pressure and misalignment of strand support rolls.

This center segregation impairs the quality of steel products, particularly, thick steel plates. For example, if a line pipe material for oil transportation or natural gas transportation has center segregation, the action of sour gas causes hydrogen induced cracking from the center segregation. Similar problems can occur also in structures including offshore structures, storage tanks, and oil tanks. Steel has therefore been frequently required to be used under severe conditions such as under a low temperature or under a highly corrosive environment, whereby reduction of center segregation in the strand has been becoming increasingly important.

Thus, a large number of countermeasures taken to reduce center segregation in the strand or render center segregation harmless have been developed throughout the procedure from the continuous casting process to the rolling process. One such countermeasure known as being particularly effective in overcoming center segregation is a "solidification-terminal stage soft reduction method", in which a continuously cast strand containing an unsolidified layer inside is pressed down in a continuous casting machine. The "solidification-terminal stage soft reduction method" is a method in which multiple pressing rolls are arranged at or around the solidification completion position of the strand and a continuously cast strand is gradually pressed down by the pressing rolls at a pressing speed approximately corresponding to the rate of solidification shrinkage to prevent occurrence of voids or flows of concentrated molten steel in the center portion of the strand, whereby the center segregation of the strand is suppressed.

For the solidification-terminal stage soft reduction method to effectively prevent center segregation from occurring, it is important to appropriately determine the start and finish time of a period, within the final solidification period of the strand, during which the strand is being subjected to soft reduction and determine the pressing rate during the soft reduction period. Various types of methods of determining the times and the rate have been developed.

For example, Japanese Unexamined Patent Application Publication No. 8-132203 describes a continuous casting method including subjecting soft reduction to a terminal solidification portion of a continuously cast strand and in which the rate at which the strand is pressed per unit time in a section in which the strand is subjected to soft reduction is determined by the strand surface temperature at the pressing start time and the thickness of the unsolidified layer of the strand at the press position.

Japanese Unexamined Patent Application Publication No. 3-90263 and Japanese Unexamined Patent Application Publication No. 3-90259 each describe a continuous steel casting method while pressing a strand with multiple pairs of rolls within a region from the time point at which a thickness-wise middle portion of the bloom strand has a temperature corresponding to the solid fraction of 0.1 to 0.3 to the time point at which the thickness-wise middle portion has a temperature corresponding to the flow-limit solid fraction. In the method, the speed at which the strand is pressed is further increased toward the downstream side in the casting direction with increasing solid fraction at the strand thickness-wise middle portion.

Japanese Unexamined Patent Application Publication No. 2003-71552 describes a continuous steel casting method with an application of pressing force to the strand being cast. In the method, the pressing conditions are determined or adjusted on the basis of the information of the shape of a cross section of the strand taken perpendicular to the longitudinal direction of the strand and the information of the shape of an unsolidified portion in the cross section.

In the continuous slab-strand casting involving solidification-terminal stage soft reduction method, when the thickness of the cast target strand varies, the time at which the soft reduction is to be started and the time at which the soft reduction is to be finished do not change regardless of the thickness of the strand, whereas the optimum pressing speed in the range in which the pressing force is applied to the strand (referred to as "soft reduction zone") changes in accordance with the thickness of the strand.

The thickness of the slab strand is determined by the thickness of the rolled steel product and the pressing ratio during rolling required for the specifications of the steel product (strand thickness/steel product thickness). Thus, when new specifications of a steel product are determined, the thickness of the strand is determined in accordance with the specifications. If a strand having the determined thickness has never been cast before with the solidification-terminal stage soft reduction method, there is a need to additionally determine an optimum pressing speed during the soft reduction for the strand thickness. Every time the optimum pressing speed is to be determined, an optimum reduction rate in the soft reduction zone is determined through casting experiments using an actual machine under the settings of various different levels of reduction rate, which requires significant time and cost. Specifically, achievement of a method of simply obtaining an optimum reduction rate in the soft reduction zone in accordance with the thickness of the slab strand has been a challenge.

The "reduction rate" refers to the state of the degree of a roll opening determined such that the distance between opposing rolls (referred to as "the roll gap") gradually decreases toward the downstream side in the casting direction. The reduction rate is usually expressed by the amount by which the degree of the roll opening decreases per 1 m (mm/m). The value obtained by multiplying the reduction rate (mm/m) by the strand withdrawal speed (m/min) is calculated as the pressing speed (mm/min).

Japanese Unexamined Patent Application Publication No. 8-132203 focuses attention on the unsolidified layer thickness of the strand as an indicator of effectively performing soft reduction. According to Japanese Unexamined Patent Application Publication No. 8-132203, this is based on the finding that the pressing rate determined for the pressing rolls is transmitted in a smaller rate to the interface of solid and liquid phases of the strand (hereinafter the rate is referred to as "pressing efficiency") on the casting downstream side, that is, with decreasing unsolidified layer thickness of the strand. However, the center segregation becomes apparent in a center region of the strand having an unsolidified layer thickness of approximately 10 mm or smaller. According to the relationship between the unsolidified layer thickness D and the pressing speed required per unit time shown in FIG. 1 of Japanese Unexamined Patent Application Publication No. 8-132203, the difference between a pressing speed required for the unsolidified layer thickness of 10 mm and a pressing speed required for the unsolidified layer thickness of 0 mm is approximately 10% at most. The Example in Japanese Unexamined Patent Application Publication No. 8-132203 describes only the test results for one strand thickness (250 mm). Thus, whether the optimum pressing conditions described in Japanese Unexamined Patent Application Publication No. 8-132203 are also effective for different strand thicknesses remains in question.

In Japanese Unexamined Patent Application Publication No. 3-90263 and Japanese Unexamined Patent Application Publication No. 3-90259, the sizes of the strands used in the test in thickness and width range between three types of 300 mm×500 mm, 162 mm×162 mm, and 380 mm×560 mm. All the strands having the above sizes relate to the soft-reduction casting of a bloom strand. Since a bloom strand has a ratio between the width and the thickness of the cross section taken perpendicular to the withdrawal direction of the strand (width/thickness) smaller than that of a slab strand, pressing efficiency in the soft reduction at the end of the solidification of a bloom strand is smaller than that in a slab strand. Accordingly, the pressing rate increases further toward the end of the solidification. The pressing rate is approximately two to three times as large as that in the slab strand in Japanese Unexamined Patent Application Publication No. 8-132203. Those pressing conditions cannot be directly used in the soft reduction of the slab strand.

In Japanese Unexamined Patent Application Publication No. 8-132203, Japanese Unexamined Patent Application Publication No. 3-90263 and Japanese Unexamined Patent Application Publication No. 3-90259, the reduction rate in the soft reduction zone is varied in the casting withdrawal direction and thus the roll gap of strand support rolls is determined with complexity, entailing complexity of the equipment structure for practice with an actual machine.

Japanese Unexamined Patent Application Publication No. 2003-71552 is directed toward a bloom strand. In Japanese Unexamined Patent Application Publication No. 2003-71552, the soft reduction conditions are determined on the basis of information of the shape of the cross section taken perpendicular to the longitudinal direction of the strand, that is, the width and the thickness of the strand. The soft reduction conditions are determined using the ratio between the width and the thickness of the strand as references and on the basis of the amount of change between the references and the ratio between the width and the thickness of the unsolidified portion of the strand. The soft reduction conditions are not determined by directly using the thickness of the strand. In the bloom strand, an unsolidified layer of the strand can have a flat shape either in the lateral direction or in the vertical direction depending on the cooling ratio between the upper and lower surfaces of the strand inside the continuous casting machine or the cooling ratio between the left and right surfaces of the strand inside the continuous casting machine. Thus, the conditions in Japanese Unexamined Patent Application Publication No. 2003-71552 are determined in the above-described manner for the purposes of enabling an optimum soft reduction in either case.

A slab strand has a far larger long side than a short side and the direction in which the unsolidified layer extends flat does not change. The unsolidified layer is always flat in the lateral direction of the strand. Thus, Japanese Unexamined Patent Application Publication No. 2003-71552 is less useful.

It could therefore be helpful to provide a continuous steel casting method with which soft reduction conditions can be determined in accordance with the thickness of a strand, thereby preventing an occurrence of center segregation in the strand due to an insufficient pressing rate or an occurrence of internal cracks in the strand due to an excessively high pressing rate.

SUMMARY

We thus provide:

[1] A continuous steel casting method of continuously casting a strand having a thickness of 160 mm to 350 mm, a width of 1600 mm to 2400 mm, and a ratio of the width to the thickness (width/thickness) of 4 to 15, the method including:

pressing a region of the strand in a soft reduction zone in which a plurality of pairs of strand support rolls that apply pressing force to the strand are disposed, the region of the strand extending from a point of time at which a strand thickness-wise middle portion has a temperature corresponding to a solid fraction of 0.1 to a point of time at which a strand thickness-wise middle portion has a temperature corresponding to a flow-limit solid fraction. A thickness of the cast target strand, a reduction rate of the soft reduction zone, and a strand withdrawal speed at which the strand is withdrawn satisfy a relationship expressed by expressions (1) and (2) below:

$$0.3/(V\times\alpha)<Z<1.5/(V\times\alpha) \quad (1), \text{ and}$$

$$\alpha=\beta\times(D/Do)+\gamma \quad (2).$$

In expressions (1) and (2), V denotes the strand withdrawal speed (m/min), α denotes a thickness coefficient (dimensionless), Z denotes the reduction rate (mm/m), D denotes a thickness (mm) of the cast target strand at a position immediately below a mold, Do denotes a thickness (mm, Do=187 mm) of a standard strand at a position immediately below a mold, and β and γ are coefficients determined by a width W (mm) of the cast target strand according to the following ranges of the width W of the strand:

$\beta=-0.61$ and $\gamma=1.54$ when $1600\leq W\leq 1800$;

$\beta=-0.60$ and $\gamma=1.57$ when $1800<W\leq 2000$;

$\beta=-0.58$ and $\gamma=1.58$ when $2000<W\leq 2200$; and $\beta=-0.53$ and $\gamma=1.54$ when $2200<W\leq 2400$.

[2] The continuous steel casting method according to the above paragraph [1], wherein the thickness of the cast target strand and a total amount by which the strand is pressed satisfy a relationship expressed by an expression (3) below:

$$Rt<(D/Do)\times(10/\alpha) \quad (3).$$

In expression (3), Rt denotes a total amount (mm) by which the strand is pressed, D denotes the thickness (mm) of the cast target strand at the position immediately below the mold, Do denotes the thickness (mm, Do=187 mm) of the standard strand at the position immediately below the mold, and $\alpha$ denotes a thickness coefficient (dimensionless).

The pressing conditions are so determined that the thickness of the cast target strand, the reduction rate in a soft reduction zone, and the withdrawal speed of the strand fall within ranges that satisfy the relationship of expressions (1) and (2) to reduce center segregation in the slab strand when the strand is continuously cast while the strand is applied with pressing force at the pressing rate approximately corresponding to the rate of solidification shrinkage in the soft reduction zone. Thus, even when the thickness of the strand varies, improved pressing conditions can be simply obtained without consuming a lot of time and cost such as performing actual experiments under various different levels. We thus enable rapid responses to requirements of manufacturing various different steel products having different specifications, thereby bringing about industrial useful effects.

REFERENCE SIGNS LIST

Figure 1:
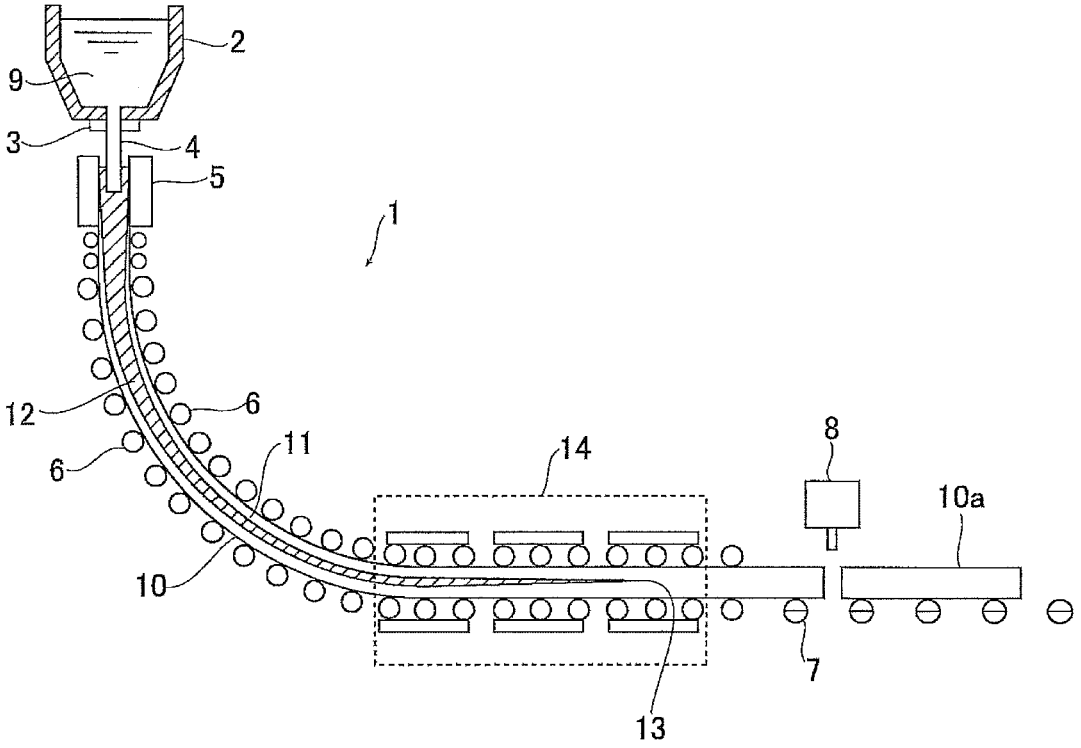
FIG. 1 is a schematic diagram of a continuous slab casting machine viewed from the side.

1 continuous slab casting machine
2 tundish
3 sliding nozzle
4 immersion nozzle
5 mold
6 strand support roll
7 transport roll
8 slab cutter
9 molten steel
10 strand
11 solidification shell
12 unsolidified layer
13 solidification completion position
14 soft reduction zone
15 roll segment
16 frame
17 tie rod
18 disk spring
19 worm jack
20 motor
21 roll chock

DETAILED DESCRIPTION

Hereinbelow, our methods are specifically described with reference to the appended drawings. FIG. 1 is a schematic diagram of a continuous slab casting machine viewed from the side.

As illustrated in FIG. 1, the continuous slab casting machine 1 includes a mold 5 that receives and solidifies molten steel 9 and forms an outer shell shape of a strand 10. A tundish 2 is disposed at an appropriate position above the mold 5 to transmit the molten steel 9 provided from a ladle (not illustrated) to the mold 5. A sliding nozzle 3 is disposed at the bottom portion of the tundish 2 to adjust the flow rate of the molten steel 9. An immersion nozzle 4 is disposed at the lower surface of the sliding nozzle 3.

Below the mold 5, on the other hand, multiple pairs of strand support rolls 6 including support rolls, guide rolls, and pinch rolls are disposed. In a secondary cooling zone, spray nozzles such as a water spray nozzle or an air mist spray nozzle (not illustrated) are disposed in gaps between strand support rolls 6 adjacent in the casting direction. The strand 10 is cooled by the cooling water (also referred to as "secondary cooling water") sprayed from the spray nozzles in the secondary cooling zone while being withdrawn. On the downstream side of the strand support rolls 6 at the end in the casting direction, multiple transport rolls 7 are disposed to transport the cast strand 10. Above the transport rolls 7, a strand cutter 8 is disposed to cut the cast strand 10 into a strand 10*a* having a predetermined length.

In an area extending from the upstream side and the downstream side of a solidification completion position 13 of the strand 10 in the casting direction, a soft reduction zone 14 constituted of a group of multiple pairs of strand support rolls is formed. In the soft reduction zone 14, the distance between the opposing strand support rolls across the strand 10 (the distance is referred to as a "roll gap") gradually decreases toward the downstream side in the casting direction, specifically, the reduction rate (the state of the roll gap that gradually decreases toward the downstream side in the casting direction) is provided. Soft reduction can be performed on the strand 10 over the entire area or a selected area of the soft reduction zone 14. Spray nozzles are also disposed in gaps between strand support rolls in the soft reduction zone 14 to cool the strand 10. The strand support rolls 6 disposed in the soft reduction zone 14 are also referred to as pressing rolls.

Normally, the reduction rate is expressed by an amount of reduction of the roll gap per meter in the casting direction, that is, "mm/m". Thus, the pressing speed (mm/min) of the strand 10 in the soft reduction zone 14 is obtained by multiplying the reduction rate (mm/m) by the strand withdrawal speed (m/min).

In the continuous slab casting machine 1 illustrated in FIG. 1, the soft reduction zone 14 is constituted of three roll segments connected in the casting direction, each of which is constituted of three pairs of strand support rolls 6. However, the soft reduction zone 14 does not have to be constituted of three roll segments. The soft reduction zone 14 may be constituted of one roll segment or two roll segments, or even four roll segments. In the continuous slab casting machine 1 illustrated in FIG. 1, each roll segment is constituted of three pairs of strand support rolls 6. However, each roll segment may be constituted of any number of pairs of strand support rolls 6 not smaller than two pairs.

Figure 2:
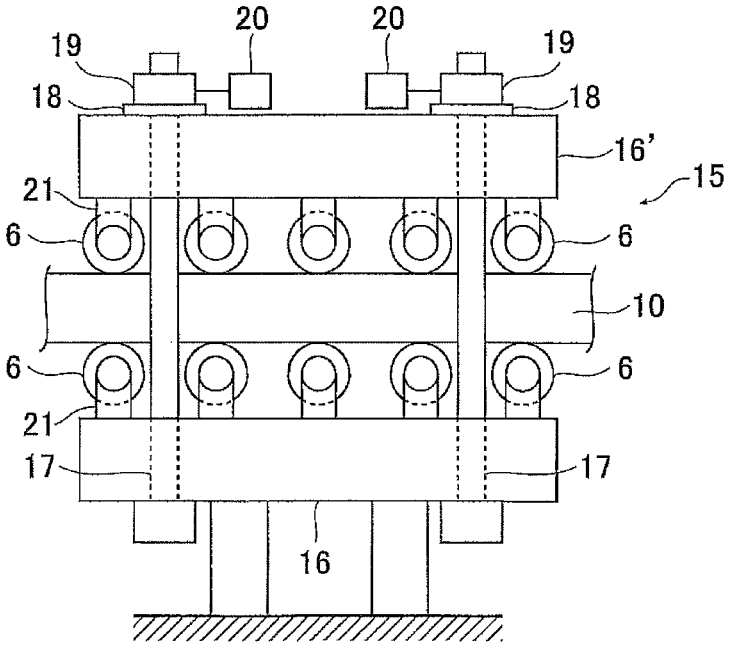
FIG. 2 is a schematic diagram of an example of a roll segment constituting a soft reduction zone of the continuous slab casting machine, viewed from the side of the continuous casting machine.
Figure 3:
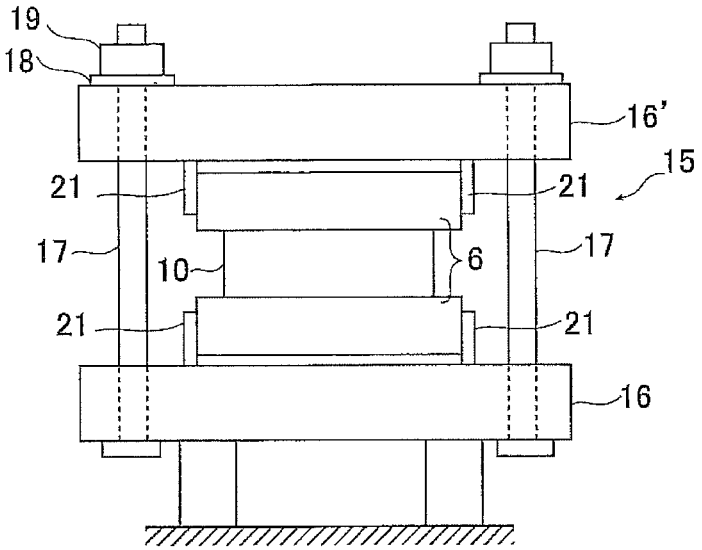
FIG. 3 is a schematic diagram of the roll segment illustrated in FIG. 2, viewed from the casting direction of the strand, that is, a schematic diagram of the roll segment in a cross section taken perpendicular to the casting direction.

FIGS. 2 and 3 illustrate an example of a roll segment constituting the soft reduction zone 14. FIGS. 2 and 3 illustrate an example of a roll segment 15 in which five pairs of strand support rolls 6 are provided as pressing rolls. FIG. 2 is a schematic diagram of the example of a roll segment viewed from the side of the continuous casting machine. FIG. 3 is a schematic diagram of the roll segment viewed from the casting direction of the strand, that is, a schematic diagram of a cross section taken perpendicular to the casting direction.

As illustrated in FIGS. 2 and 3, the roll segment 15 includes a pair of frames, including a frame 16 and a frame 16', that hold five pairs of strand support rolls 6 with roll chocks 21 interposed therebetween. Four tie rods 17 are disposed (on both sides at an upstream portion and on both sides at a downstream portion) to extend through the frame 16 and the frame 16'. The distance between the frame 16 and the frame 16' is adjusted, that is, the reduction rate in the roll segment 15 is adjusted by driving worm jacks 19 disposed on the respective tie rods 17 using motors 20. In this case, the roll gap defined by the five pairs of strand support rolls 6 in the roll segment 15 is entirely adjusted by one operation.

In casting, the worm jacks 19 self-lock with the molten steel static pressure of the strand 10 containing an unsolidified layer to act against the bulging force of the strand 10. Thus, the reduction rate is adjusted under the conditions where no strand 10 exists, that is, under the conditions where no load is exerted from the strand 10 on the strand support rolls 6 disposed in the roll segment 15. The amount by which the frame 16' is shifted by the worm jacks 19 is measured and controlled using the rotation rate of the worm jacks 19 to render the reduction rate of the roll segment 15 known.

A disk spring 18 is disposed on each tie rod 17 between the frame 16' and the corresponding worm jack 19. Each disk spring 18 does not consist of one disk spring piece, but is constituted of multiple disk spring pieces stacked one on top of another (the more disk spring pieces are stacked, the higher solidification the disk spring has). Unless a predetermined or heavier load acts on the disk spring 18, the disk spring 18 retains a certain thickness without shrinking. When a predetermined load acts on the disk spring 18, the disk spring 18 starts shrinking. When a load exceeding the predetermined load acts on the disk spring 18, the disk spring 18 shrinks in proportion to the load.

For example, when the strand 10 finishes solidifying within the range of the roll segment 15, pressing the completely solidified strand 10 causes an excessive load on the roll segment 15. When such an excessive load is to be exerted on the roll segment 15, the disk springs 18 shrink so that the frame 16' is released, that is, the roll gap increases to not exert an excessive load on the roll segment 15. The frame 16 disposed at the bottom side is fixed to the foundation of the continuous casting machine and does not move during casting.

Although not illustrated, the strand support rolls 6 other than the strand support rolls disposed in the soft reduction zone 14 have a roll segment structure.

The soft reduction zone 14 illustrated in FIG. 1 has such a roll segment structure. Thus, the roll gap defined by three pairs of strand support rolls 6 disposed in each roll segment is entirely adjusted by one operation. In this case, the amount by which an upper frame (corresponding to the frame 16') is shifted by the worm jack is measured and controlled with the rotation rate of the worm jack so that the reduction rate of each roll segment is known.

In the continuous slab casting machine 1 having the above-described structure, the molten steel 9 poured into the mold 5 from the tundish 2 through the immersion nozzle 4 is cooled by the mold 5, forms a solidification shell 11, and becomes a strand 10 containing an unsolidified layer 12 inside. The strand 10 is continuously withdrawn downwardly from the mold 5 while being supported by the strand support rolls 6 disposed downwardly from the mold 5. While passing between the strand support rolls 6, the strand 10 is cooled by secondary cooling water in the secondary cooling zone, increases the thickness of the solidification shell 11, and is pressed down in the soft reduction zone 14 so that the strand 10 completely solidifies up to the inside on arrival at the solidification completion position 13. The completely solidified strand 10 is cut by the strand cutter 8 into a strand 10*a*.

The strand 10 is pressed down in the soft reduction zone 14 at least during a period from the time point at which the strand thickness-wise middle portion has a temperature corresponding to the solid fraction of 0.1 to the time point at which the strand thickness-wise middle portion has a temperature corresponding to the flow-limit solid fraction. The flow-limit solid fraction is 0.7 to 0.8 and thus the strand is pressed until the solid fraction of the strand thickness-wise middle portion arrives at a value of 0.7 to 0.8. Thus, pressing the strand until the solid fraction of the strand thickness-wise middle portion arrives at or exceeds 0.8 is not a problem. After the solid fraction of the strand thickness-wise middle portion exceeds the flow-limit solid fraction, performing the soft reduction is meaningless since the unsolidified layer 12 no longer moves. Although the soft reduction is no longer effective, the soft reduction may be performed after the solid fraction of the strand thickness-wise middle portion exceeds the flow-limit solid fraction. On the other hand, once the solid fraction of the strand thickness-wise middle portion exceeds 0.1, concentrated molten steel may start flowing before soft reduction is started. The flow of concentrated molten steel causes center segregation, failing to obtain a sufficiently high center segregation reduction effect. For this reason, the soft reduction is to be started before the solid fraction of the strand thickness-wise middle portion arrives at 0.1.

The solid fraction of the strand thickness-wise middle portion can be calculated by two-dimensional heat-transfer solidification calculation. The solid fraction is determined as zero before the start of solidification and as 1.0 after the completion of solidification. The position at which the solid fraction of the strand thickness-wise middle portion arrives at 1.0 corresponds to the solidification completion position 13.

It is generally well known that center segregation in the strand 10 is reduced by performing soft reduction on the strand 10 at a predetermined pressing speed at the end of the solidification of the molten steel 9. During the soft reduction, however, the pressing speed may fail to be controlled in the manner as designed since deformation of the solidification shell 11 caused by pressing may lower the pressing rate transmitted to the solidification interface of the strand 10 compared to the pressing rate at which the strand surface is pressed. The ratio of the pressing rate transmitted to the solidification interface of the strand 10 to the pressing rate at which the strand surface is pressed (pressing rate transmitted to the solidification interface/pressing rate at which the strand surface is pressed) is referred to as pressing efficiency.

The thickness of the solidification shell 11 particularly significantly serves as a cause that affects pressing efficiency. Pressing efficiency decreases with increasing thickness of the solidification shell 11. Specifically, since the strand 10 is subjected to soft reduction at the end of solidification, a strand 10 having a larger peripheral thickness has a larger thickness of the solidification shell 11 during the soft reduction, whereby the pressing efficiency during the soft reduction is smaller. The peripheral thickness of the strand 10 is determined by the thickness extending in the direction of the short sides of the mold in the cavity (internal space in the mold) at the mold outlet.

To reduce center segregation with soft reduction performed under controlled pressing conditions regardless of a strand thickness when a strand 10 having a fixed strand width of 2100 mm and a strand thickness of 160 mm to 350 mm is continuously cast, we first calculated, through casting experiments using an actual machine, a controlled range of the reduction rate in the soft reduction zone 14 when a strand 10 having a thickness of 200 mm is continuously cast. As a result of the experiments, the desired reduction rate for the strand 10 having a thickness of 200 mm has been found to fall within the range expressed by expression (4):

$$0.3/V<Z<1.5/V \quad (4).$$

In expression (4), V denotes the strand withdrawal speed (m/min) and Z denotes the reduction rate (mm/m).

Subsequently, to incorporate into expression (4) a correction value that compensates the pressing efficiency for the effect of the thickness of the strand 10, a numerical calculation relating to the deformation of the strand 10 during soft reduction was performed for various different strand thicknesses of 160 mm to 350 mm. From the calculation results, the relationship between the thickness of the strand 10 and the pressing efficiency was obtained and a thickness coefficient α (dimensionless) was derived as a primary approximate expression of the strand thickness as expression (5) below:

$$\alpha=-0.58\times(D/Do)+1.58 \quad (5).$$

In expression (5), D denotes the thickness (mm) of the cast target strand at a position immediately below a mold and Do denotes the thickness (mm) of a reference strand at a position immediately below a mold.

The thickness coefficient α decreases with increasing strand thickness D. This means that the pressing efficiency decreases with increasing strand thickness D. The thickness Do of the reference strand at a position immediately under the mold is a strand thickness with which the thickness coefficient α expressed in expression (5) is 1. The thickness Do is 187 mm in the case of the slab strand having a width of 2100 mm.

When the thickness of the cast target strand 10 is different from the reference thickness of 187 mm, the pressing efficiency changes in accordance with the difference of the strand thickness at the rate expressed by expression (5). The degree of change in pressing efficiency due to the difference of the strand thickness is compensated by adjusting the reduction rate in the soft reduction zone 14. Specifically, the reduction rate is increased when the pressing efficiency is small whereas the reduction rate is reduced when the pressing efficiency is large so that the degree of change in the pressing efficiency is compensated. In other words, the thickness coefficient α expressed in expression (5) is incorporated into expression (4) to obtain expression (1) as a relational expression between the strand withdrawal speed, the thickness coefficient α, and the reduction rate:

$$0.3/(V\times\alpha)<Z<1.5/(V\times\alpha) \quad (1).$$

If the continuous casting is performed in accordance with expression (1) and expression (5) thus obtained when a strand 10 having a strand width of 2100 mm and a strand thickness of 160 mm to 350 mm is continuously cast, the change of the pressing efficiency due to an increase or decrease of the strand thickness can be prevented. Thus, the occurrence of center segregation or porosity in the strand 10 can be prevented and the occurrence of inverted-V segregation or internal cracks in the strand 10 due to excessive pressing can be prevented.

The thickness coefficient α in expression (5) is the coefficient for the strand 10 having a fixed strand width of 2100 mm. On the other hand, the width of the strand 10 that is cast by the continuous slab casting machine 1 widely ranges from 1600 mm to 2400 mm. Thus, we decided to obtain the thickness coefficient α for all types of strands at a thickness of 160 to 350 mm, a width of 1600 to 2400 mm, and the ratio of the width to the thickness (width/thickness) of 4 to 15.

The main bodies that serve as resistance against pressing during the soft reduction in the soft reduction zone 14 are portions on the short sides of the strand that have finished solidifying. When the strand 10 has an even thickness, the absolute values of the dimension of these portions in the strand width direction are substantially equal to each other regardless of the width of the strand 10. In the region of the strand containing the unsolidified layer 12 inside, the existence of the unsolidified layer 12 renders the pressing resistance so small as to be negligible compared to the portions on both ends on the short sides of the strand that have finished solidifying.

Specifically, for example, the ratio of the completely solidified portions on the short sides of the strand to the strand width in the strand having a width of 1600 mm is larger than that in the strand having a width of 2100 mm, whereby the pressing resistance in the strand having a width of 1600 mm width is larger than that in the strand having a width of 2100 mm. Thus, when the same reduction rate in the soft reduction zone 14 is determined for a strand having a width of 1600 mm and for a strand having a width of 2100 mm, the actual reduction rate for the strand having a width of 1600 mm may become smaller than the determined reduction rate with the effect of the reaction force against the pressing resistance exceeding the determined stress of the disk springs 18 and an increase of the roll gap.

To address this situation, numerical calculations similar to the numerical calculation performed on the strand having a width of 2100 mm were also performed on strands having strand widths of 1700 mm, 1900 mm, and 2300 mm to obtain thickness coefficients α for these strands. Each thickness coefficient α was expressed by expression (2) including coefficients β and γ, determined by the width W (mm) of a cast target strand:

$$\alpha=\beta\times(D/Do)+\gamma \quad (2).$$

From the results of the numerical calculations, the coefficient β and the coefficient γ in expression (2) were found to take the following values in accordance with the width W (mm) of the cast target strand:

$\beta=-0.61$ and $\gamma=1.54$ when $1600\leq W\leq 1800$;

$\beta=-0.60$ and $\gamma=1.57$ when $1800<W\leq 2000$; and $\beta=-0.53$ and $\gamma=1.54$ when $2200<W\leq 2400$.

wherein $\beta=-0.58$ and $\gamma=1.58$ when $2000<W\leq 2200$ as illustrated in expression (5).

The thickness Do of the reference strand at a position immediately under the mold in expression (2) was determined as 187 mm in the slab strand having a width of 1600 mm to 2400 mm regardless of the width of the slab strand, as in the slab strand having a width of 2100 mm.

Although soft reduction is effective in preventing concentrated molten steel from flowing at the end portion of solidification, the soft reduction may cause internal cracks at the solidification interface since pressing causes deformation of the strand 10. It is known that such internal cracks occur when the accumulated strain exerted on the solidification interface arrives at a predetermined value.

Thus, we investigated the relationship between a total amount by which the strand 10 is pressed in soft reduction and the occurrence of internal cracks using an actual machine. As a result, we confirmed that, to prevent internal cracks in the strand 10, it is preferable that the total amount by which the strand 10 is pressed and the thickness of the cast target strand satisfy the relationship expressed by expression (3):

$$Rt<(D/Do)\times(10/\alpha) \quad (3).$$

wherein Rt in expression (3) denotes the total amount (mm) by which the strand is pressed.

Specifically, our methods include continuous casting in which pressing conditions are so determined that the thickness of a cast target strand 10, the reduction rate of the soft reduction zone 14, and the strand withdrawal speed at which the strand is withdrawn fall within ranges that satisfy the relationship expressed by expressions (1) and (2). At this time, the total amount by which the strand 10 is pressed and the thickness of the cast target strand are preferably determined to fall within ranges that satisfy the relationship expressed by expression (3).

In addition, the thickness of the solidification shell 11 and the solid fraction of the strand thickness-wise middle portion are calculated in advance using two-dimensional heat-transfer solidification calculation or the like under various casting conditions in the continuous casting operation. Thus, the rate of secondary cooling water or the strand withdrawal speed are adjusted so that the solid fraction of the strand thickness-wise middle portion at the time point when the strand enters the soft reduction zone 14 becomes 0.1 or smaller and the solid fraction of the strand thickness-wise middle portion at the time point when the strand exits from the soft reduction zone 14 arrives at or exceeds the flow-limit solid fraction.

As described above, the pressing conditions are determined so that the thickness of the cast target strand 10, the reduction rate of the soft reduction zone 14, and the strand withdrawal speed fall within ranges that satisfy the relationship expressed by expressions (1) and (2). Thus, controlled pressing conditions can be easily calculated for strands 10 having different thicknesses, whereby requirements for production of steel products having various different specifications can be quickly fulfilled.

EXAMPLE

Hereinbelow, our methods are further described in detail using examples.

A continuous casting machine used for testing is similar to the continuous casting machine 1 illustrated in FIG. 1. Low carbon aluminum killed steel was cast using this continuous casting machine. Table 1 shows the results of investigation with regard to the degree of center segregation, the occurrence of porosity, or the occurrence of internal cracks in the cast strand, the results being obtained after performing the continuous casting method according to an example under the casting conditions for three types of strand thickness, including 200 mm, 250 mm, and 300 mm. Table 1 also shows the casting conditions and the investigation results of the tests performed as comparative examples for respective strand thicknesses under the conditions that fall out of our range. The width of the strands is set at 2100 mm throughout the tests.

TABLE 1

| Sample No. | Strand Thickness (mm) | Water Flow Rate (L/steel-kg) | Strand Withdraw Speed (m/min) | Reduction Rate (mm/m) | Total Amount Pressed (mm) | Degree of Center Segregation ($Cmax/C_0$) | Porosity | Internal Crack | Note |
|---|---|---|---|---|---|---|---|---|---|
| 1 | 200 | 1.6 | 1.40 | 0.8 | 4.8 | 1.065 | None | None | Example |
| 2 | | 1.4 | 1.60 | 0.8 | 8.0 | 1.061 | None | None | Example |
| 3 | | 1.2 | 1.80 | 0.5 | 4.0 | 1.046 | None | None | Example |
| 4 | | 1.6 | 1.40 | 1.5 | 20.0 | 1.103 | None | Present | Comparative Example |
| 5 | | 1.5 | 1.40 | 0.2 | 2.0 | 1.121 | Present | None | Comparative Example |
| 6 | 250 | 1.6 | 1.10 | 0.7 | 7.0 | 1.044 | None | None | Example |
| 7 | | 1.3 | 1.25 | 0.6 | 6.0 | 1.046 | None | None | Example |
| 8 | | 1.1 | 1.60 | 0.4 | 3.2 | 1.057 | None | None | Example |
| 9 | | 1.4 | 1.60 | 2.0 | 24.0 | 1.121 | None | Present | Comparative Example |
| 10 | | 1.4 | 1.40 | 0.2 | 2.0 | 1.133 | Present | None | Comparative Example |
| 11 | 300 | 1.1 | 0.75 | 1.2 | 12.0 | 1.042 | None | None | Example |
| 12 | | 0.9 | 0.75 | 1.1 | 11.0 | 1.030 | None | None | Example |
| 13 | | 0.8 | 0.90 | 1.1 | 11.0 | 1.069 | None | None | Example |
| 14 | | 0.8 | 0.90 | 3.0 | 15.0 | 1.098 | None | Present | Comparative Example |
| 15 | | 0.9 | 0.75 | 0.5 | 5.0 | 1.132 | Present | None | Comparative Example |

The degree of center segregation of the strands used for evaluation in the test was measured in the following manner. Specifically, the carbon concentration in the cross section taken perpendicular to the withdrawal direction of each strand was analyzed at equal intervals in the thickness direction of the strand. The degree of center segregation was determined as $C_{max}/C_0$ where $C_{max}$ denotes the maximum value of analysis in the thickness direction and $C_0$ denotes the carbon concentration analyzed in the molten steel taken from the tundish during casting. Thus, a strand that has a degree of center segregation closer to 1.0 is a more preferable strand having less center segregation. A strand having the degree of center segregation of 1.10 or higher is determined as having an undesirable level of center segregation.

Whether porosity or internal cracks of each strand is/are present was determined through microscopic observation of the cross section of the strand taken perpendicular to the withdrawal direction of the strand at or around a center portion of the strand thickness.

The strand withdrawal speed at which each of strands having different strand thicknesses is withdrawn was determined so that at least a region of the strand in which the thickness-wise middle portion has a solid fraction in the range from 0.1 to the flow-limit solid fraction is located in the soft reduction zone. In Sample Nos. 1 to 3, Sample Nos. 6 to 8, and Sample Nos. 11 to 13, the reduction rate was determined to satisfy expressions (1) and (2). In Sample Nos. 4, 9, and 14 tested as comparative examples, the reduction rate was so determined as to exceed the upper limit of the controlled range of the reduction rate determined by expressions (1) and (2). In Sample Nos. 5, 10, and 15, the reduction rate was so determined as to fall below the lower limit of the controlled range of the reduction rate determined by expressions (1) and (2). In Sample Nos. 4 and 9, the reduction rate was determined so that the total amount pressed exceeds the upper limit of expression (3).

As is clear from the degree of center segregation shown in Table 1, the degree of center segregation in each of Sample Nos. 1 to 3, Sample Nos. 6 to 8, and Sample Nos. 11 to 13 within our range was below 1.10, which was preferable. Neither porosity nor internal cracks were found in each of the above strands.

In Sample No. 4 tested as a comparative example, the reduction rate was determined as an excessive value of 1.5 mm/m although the controlled reduction rate obtained through expressions (1) and (2) was 0.2 to 1.1 mm/m, whereby the degree of center segregation exceeded 1.10. In addition, the total amount pressed was also excessive, whereby internal cracks occurred in the strand. Similarly, Sample Nos. 9 and 14 each had an excessive reduction rate and a high degree of center segregation, and inverted-V segregation was also partially observed.

In Sample No. 15, the reduction rate was determined as being 0.5 mm/m although the controlled reduction rate obtained through expressions (1) and (2) was 0.6 to 3.1 mm/m. Thus, the reduction rate was insufficient, the degree of center segregation exceeded 1.10, and the porosity was also observed inside the strand. Similarly, in Sample Nos. 5 and 10, the reduction rate was excessively small and the level of center segregation was undesirable.

The invention claimed is:

1. A method of continuously casting a strand having a thickness of 160 mm to 350 mm, a width of 1600 mm to 2400 mm, and a ratio of the width to the thickness (width/thickness) of 4 to 15, comprising:

pressing a region of the strand in a soft reduction zone in which a plurality of pairs of strand support rolls that apply pressing force to the strand are disposed, the region of the strand extending from a location at which a strand thickness-wise middle portion has a temperature corresponding to a solid fraction of 0.1 to a location at which a strand thickness-wise middle portion has a temperature corresponding to a flow-limit solid fraction, wherein a thickness of the cast target strand, a reduction rate of the soft reduction zone, and a strand withdrawal speed at which the strand is withdrawn satisfy expressions (1) and (2):

$$0.3/(V\times\alpha)<Z<1.5/(V\times\alpha) \quad (1), \text{ and}$$

$$\alpha=\beta\times(D/Do)+\gamma \quad (2), \text{ and}$$

in expressions (1) and (2),

V denotes the strand withdrawal speed (m/min),

α denotes a thickness coefficient (dimensionless),

Z denotes the reduction rate (mm/m),

D denotes a thickness (mm) of the cast target strand at a position immediately below a mold, Do denotes a thickness (mm, Do =187 mm) of a reference strand at a position immediately below a mold, and β and γ are coefficients determined by a width W (mm) of the cast target strand according to ranges of the width W of the strand:

$\beta=-0.61$ and $\gamma=1.54$ when $1600\leq W\leq 1800$;

$\beta=-0.60$ and $\gamma=1.57$ when $1800<W\leq 2000$;

$\beta=-0.58$ and $\gamma=1.58$ when $2000<W\leq 2200$; and $\beta=-0.53$ and $\gamma=1.54$ when $2200<W\leq 2400$.

2. The continuous steel casting method according to claim 1, wherein the thickness of the cast target strand and a total amount by which the strand is pressed satisfy expression (3):

$$Rt<(D/Do)\times(10/\alpha) \quad (3),$$

wherein,

Rt denotes a total amount (mm) by which the strand is pressed,

D denotes the thickness (mm) of the cast target strand at the position immediately below the mold, Do denotes the thickness (mm, Do=187 mm) of the reference strand at the position immediately below the mold, and α denotes a thickness coefficient (dimensionless).

* * * * *